US008387964B2

(12) United States Patent
Saito et al.

(10) Patent No.: US 8,387,964 B2
(45) Date of Patent: Mar. 5, 2013

(54) CREASING DEVICE AND IMAGE FORMING SYSTEM

(75) Inventors: Takashi Saito, Kanagawa (JP); Naohiro Kikkawa, Kanagawa (JP); Hitoshi Hattori, Tokyo (JP); Shuuya Nagasako, Kanagawa (JP); Naoyuki Ishikawa, Kanagawa (JP); Yuusuke Shibasaki, Kanagawa (JP); Hidetoshi Kojima, Miyagi (JP); Naoki Oikawa, Miyagi (JP); Go Aiba, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/064,607

(22) Filed: Apr. 4, 2011

(65) Prior Publication Data

US 2011/0245055 A1 Oct. 6, 2011

(30) Foreign Application Priority Data

Apr. 5, 2010 (JP) ..... 2010-086953
Jan. 27, 2011 (JP) ..... 2011-015436

(51) Int. Cl.
*B31F 1/08* (2006.01)

(52) U.S. Cl. ..... 270/45; 270/32; 270/58.07

(58) Field of Classification Search ..... 270/32, 270/37, 45, 58.07; 493/59, 355, 396, 397, 493/240, 242
See application file for complete search history.

(56) References Cited

U.S. PATENT DOCUMENTS 6,220,592 B1 * 4/2001 Watanabe et al. ..... 271/241
7,597,311 B2 * 10/2009 Kawata et al. ..... 270/37
7,740,238 B2 * 6/2010 Iijima et al. ..... 270/37
7,770,876 B2 * 8/2010 Sasahara ..... 270/32
7,913,988 B2 * 3/2011 Awano ..... 270/45
2008/0211158 A1 * 9/2008 Fukasawa et al. ..... 270/1.01
2008/0211159 A1 * 9/2008 Iijima et al. ..... 270/37
2009/0062096 A1 * 3/2009 Sasahara ..... 493/396
2009/0121408 A1 * 5/2009 Awano ..... 270/37
2009/0181840 A1 * 7/2009 Awano ..... 493/399
2010/0258994 A1 10/2010 Kikkawa et al.
2010/0303585 A1 12/2010 Asami et al.
2010/0310340 A1 12/2010 Suzuki et al.
2011/0064541 A1 3/2011 Kikkawa et al.

FOREIGN PATENT DOCUMENTS

EP 2 090 537 8/2009
JP 60262771 A 12/1985
JP 2001010759 A * 1/2001

OTHER PUBLICATIONS

Extended European search report for corresponding European patent application No. 11250397.4 dated Jul. 26, 2011.
Abstract of JP 60-262771 published Dec. 26, 1985.

* cited by examiner

*Primary Examiner* — Leslie A Nicholson, III
(74) *Attorney, Agent, or Firm* — Harness, Dickey & Pierce, P.L.C.

(57) ABSTRACT

A creasing device includes a creasing unit that creases sheets on a one-by-one basis, which is conveyed to a folding device of a subsequent stage, a sheet detection unit that detects a position of a sheet delivered to the creasing device and a control unit that obtains reference information of a fold-position for the folding device and performs control of a stop position of the sheet according to reference information of the fold position, thereby adjusting a crease position.

12 Claims, 19 Drawing Sheets

| FOLD MODE / SHEET SIZE | CENTER FOLD | FIRST FOLD POSITION FOR Z-FOLD | SECOND FOLD POSITION FOR Z-FOLD | ··· |
|---|---|---|---|---|
| B5 | SN3 | SN1 | SN3 | · |
| A4 | SN3 | SN1 | SN3 | · |
| A3 | SN1 | SN1 | SN3 | · |
| · | · | · | · | · |
| · | · | · | · | · |

CREASING DEVICE AND IMAGE FORMING SYSTEM

CROSS-REFERENCE TO RELATED APPLICATIONS

The present application claims priority to and incorporates by reference the entire contents of Japanese Patent Application No. 2010-086953 filed in Japan on Apr. 5, 2010 and Japanese Patent Application No. 2011-015436 filed in Japan on Jan. 27, 2011.

BACKGROUND OF THE INVENTION

1. Field of the Invention

The present invention relates to a creasing device and to an image forming system.

2. Description of the Related Art

What is called saddle-stitched or center-folded booklet production has been conventionally performed. The saddle-stitched booklet production is performed by saddle stitching a sheet batch, in which a plurality of sheets delivered from an image forming apparatus is bundled together, and folding the thus-saddle-stitched sheet batch in the middle of the sheet batch. Folding such a sheet batch containing a plurality of sheets can cause outer sheets of the sheet batch to be stretched at a folded portion by an amount greater than inner sheets. Image portions at the folded portion on outer sheets can thus be stretched, thereby causing damage, such as come off of toner, to the image portions in some cases. A similar phenomenon can occur when other folding treatment, such as z-fold or tri-fold, is performed. A sheet batch can be folded insufficiently depending on the thickness of the sheet batch.

Creasing (scoring) devices that, to prevent come off of toner, creases at folded portion of a sheet batch prior to a folding treatment where the sheet batch undergoes single fold or the like so that even outer sheets is liable to be folded have already been known. Known examples of devices of this type include a device disclosed in Japanese Patent Application Laid-open No. S60-262771.

This known example device includes a conveying belt that conveys sheets, a pressing member that uplift a sheet-conveying surface of the conveying belt, and a V-belt that rotates in pressure contact with a sheet on the conveying belt uplifted by the pressing member and forms a crease (fold stripe) in advance in sheets, which are to be saddle stitched, for quality enhancement of saddle stitching.

Known creasing devices are configured such that a sheet detection reference position for determining a crease position, and a sheet detection reference position for a unit that performs folding treatment in a subsequent process differ from each other. More specifically, for instance, a sheet is creased at a predetermined position with reference to a front edge of a sheet, the sheet is folded at a predetermined position with reference to a rear edge of the sheet in a folding treatment of a subsequent process. Meanwhile, even sheets of a same size can be dimensionally varied because of allowance or the like. Accordingly, such a configuration as discussed above can cause an offset between the crease position and the fold position, resulting in degradation of folding quality.

The known technique discussed above allows a crease to be formed in sheets, which are to be saddle stitched, on a fold stripe in advance; however, the technique gives no consideration to the offset, as discussed above, where a sheet detection reference position for determining a crease position, and a sheet detection reference position for a unit that performs folding in a subsequent process differ from each other.

SUMMARY OF THE INVENTION

It is an object of the present invention to at least partially solve the problems in the conventional technology.

According to an aspect of the present invention, there is provided a creasing device including: a creasing unit that creases sheets on a one-by-one basis, which is conveyed to a folding device of a subsequent stage; a sheet detection unit that detects a position of a sheet delivered to the creasing device; and a control unit that obtains reference information of a fold-position for the folding device and performs control of a stop position of the sheet according to reference information of the fold position, thereby adjusting a crease position.

According to an another aspect of the present invention, there is provided an image forming system including: the creasing device according to claim 1 the creasing device including: a creasing unit that creases sheets on a one-by-one basis, which is conveyed to a folding device of a subsequent stage; a sheet detection unit that detects a position of a sheet delivered to the creasing device; and a control unit that obtains reference information of a fold-position for the folding device and performs control of a stop position of the sheet according to reference information of the fold position, thereby adjusting a crease position; and an image forming apparatus for forming an image on a sheet member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention relates to a creasing device that saddle-stitches a batch of sheet members (hereinafter, "sheets") delivered from a preceding stage and creases the sheets prior to folding the sheets in the middle of the sheets and to an image forming system including the creasing device and an image forming apparatus.

The present invention has been conceived to prevent occurrence of offset between a crease position and a fold position even when sheets are dimensionally varied. This can be attained by performing detection of sheet position for creasing relative to a sheet position reference for a folding process, which is a subsequent process, and creasing a sheet based on the detected sheet reference position. For instance, if a fold position is determined by reference to a front edge of a sheet, by determining a crease position also by reference to the front edge of the sheet, offset between a fold position and a crease position can be prevented. Hence, even when sheets are dimensionally varied, offset between a crease and a fold position that can result from the variance can be prevented.

In the embodiments discussed below, an example of the creasing means is a creasing unit C; examples of the folding device are a folding device B and a folding device Br; an example of the creasing device is a creasing device A; examples of the sheet sensing unit are first to third sheet sensors SN1, SN2, and SN3; an example of the control unit is a central processing unit (CPU) 111; an example of the storing unit is random access memory (RAM) (not shown); an example of the table is given in FIG. 30; an example of the image forming apparatus is an image forming apparatus E.

Exemplary embodiments of the present invention are described in detail below by way of example implementations with reference to the accompanying drawings.

First Example

Figure 1:
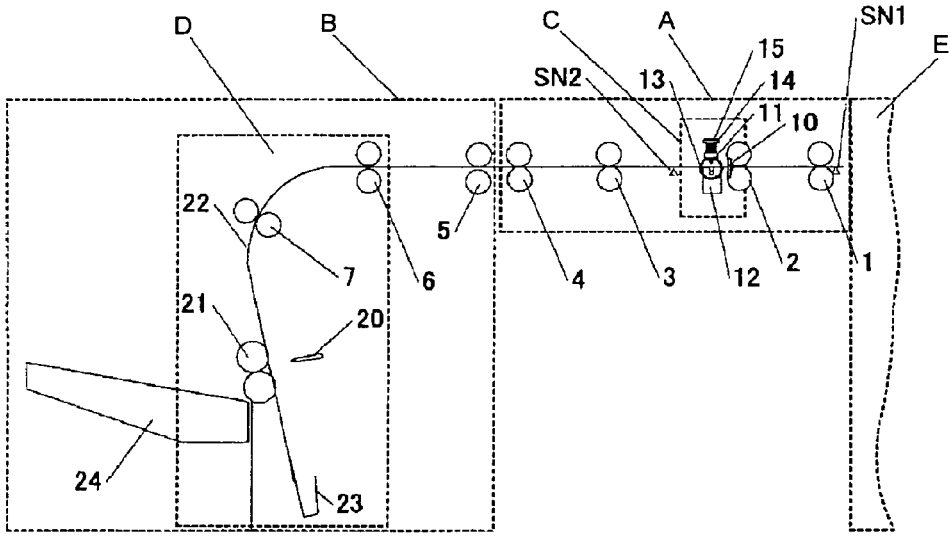
FIG. 1 is a schematic diagram illustrating a system configuration of an image forming system including a front-edge-based folding device according to a first example of an embodiment of the present invention.

FIG. 1 is a schematic diagram illustrating a system configuration of an image forming system according to implementation of a first example of an embodiment of the present invention. Referring to FIG. 1, the image forming system according to the first example includes a creasing device A, a folding device B that performs folding treatment, and an image forming apparatus E that forms a visible image on a sheet. The creasing device A includes first to fourth pairs of conveying rollers 1, 2, 3, and 4, an abutment plate 10, and a creasing unit C. The creasing unit C includes a creasing blade 11 (convex blade or creasing blade) and a receiving member 12 (creasing channel or concave channel). Creasing is performed by pinching a sheet between the creasing blade 11 and the receiving member 12 to form a crease, or a fold line, in the sheet.

The creasing blade 11 includes a convex blade portion extending in a direction orthogonal to a sheet conveying direction, a cam 13 that moves the convex blade portion up and down, and a drive mechanism (not shown). The convex blade portion includes a blade that is V-shaped in cross section and edged at its tip and a base 15 to be driven by the cam 13. The receiving member 12 includes a channel portion that is V-shaped in cross section to conform to the shape of the blade. When a sheet is pinched between the blade portion and the channel portion, a fold line is formed in the sheet. The creased sheet is delivered to the folding device B downstream.

The folding device B includes fifth, sixth, and seventh pairs of conveying rollers 5, 6, and 7 and a folding unit D. The folding unit D includes a folding tray 22, a reference fence 23, a pair of folding rollers 21, a folding plate 20, and a stacking tray 24. The folding tray 22 receives a sheet P1 from the seventh conveying rollers 7 positioned on the side of an upper end of the folding tray 22 and carries the sheet with a front edge of the sheet abutting on the reference fence 23. The pair of folding rollers 21 and the folding plate 20 are arranged facing each other with the folding tray 22 therebetween. The folding plate 20 is arranged on the same side as inside of a folded sheet whereas the pair of folding rollers 21 is positioned on the same side as outside of the folded sheet. The stacking tray 24 is located downstream in the sheet conveying direction from the pair of folding rollers 21 to receive a folded sheet or a folded sheet batch to be stacked thereon.

The image forming apparatus E forms an image pertaining to image data fed from a scanner, a personal computer (PC), or the like on a sheet as a visible image. The image forming apparatus E performs image forming by using a known print engine for electrophotographic printing, droplet ejection printing, or the like.

As will be described later, a CPU of a control device of the image forming apparatus E, that of the creasing device A, and that of the folding device B are in-line connected via interfaces; instructions fed from the image forming apparatus E are transmitted to the creasing device A and to the folding device B via the creasing device A; detection information, processing information, and the like are transmitted from the folding device B to the image forming apparatus E via the creasing device A; processing information is transmitted from the creasing device A to the image forming apparatus E; overall control of the image forming system is performed by the CPU of the image forming apparatus E.

Figure 2:
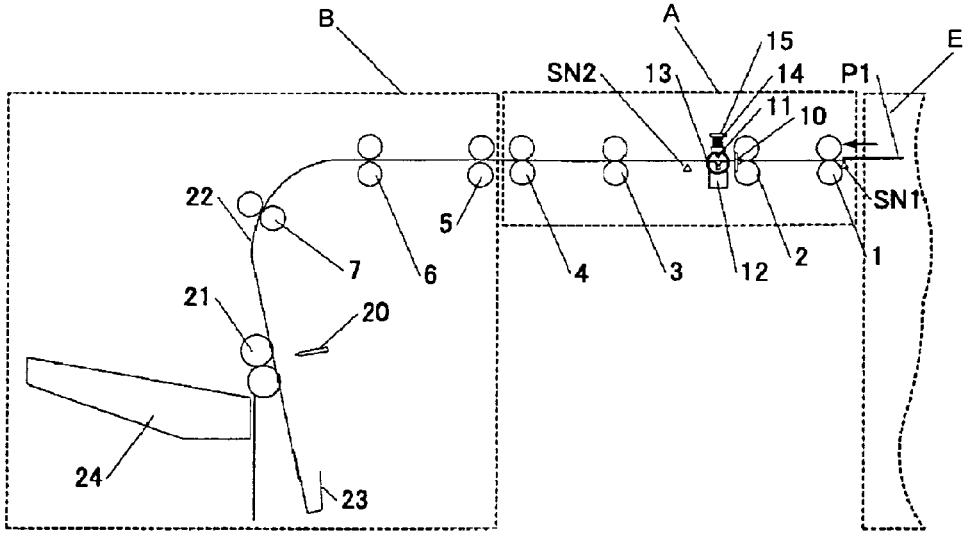
FIG. 2 is a schematic diagram of the first example for illustrating a series of operations from creasing to folding related to the front-edge-based folding device, the diagram illustrating a situation where a front edge of a first sheet has reached a position of an entrance sensor.
Figure 3:
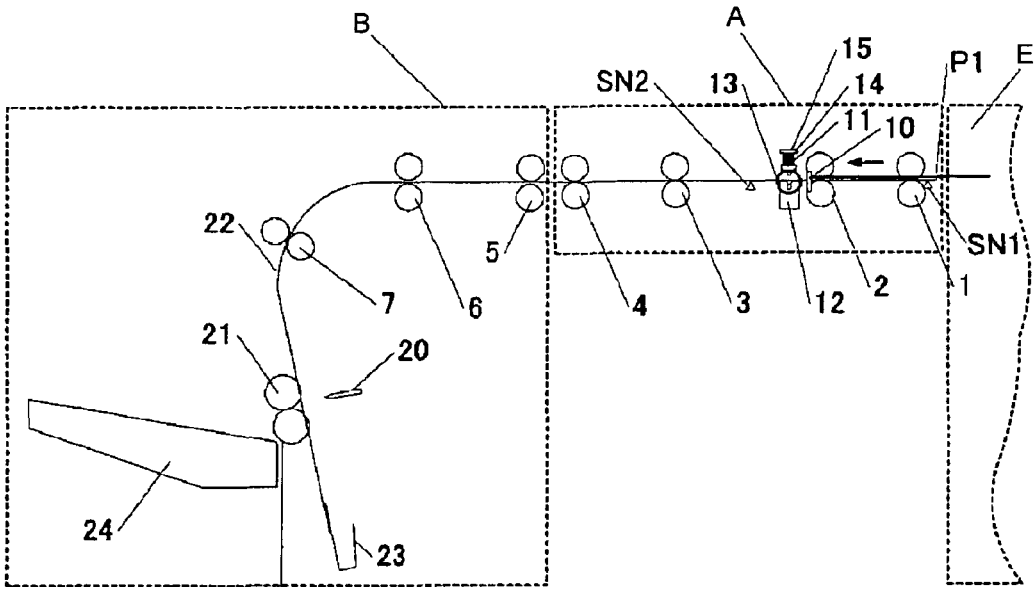
FIG. 3 is a schematic diagram for illustrating an operating state, following the situation of FIG. 2, where the sheet is brought into contact with an abutment plate.
Figure 4:
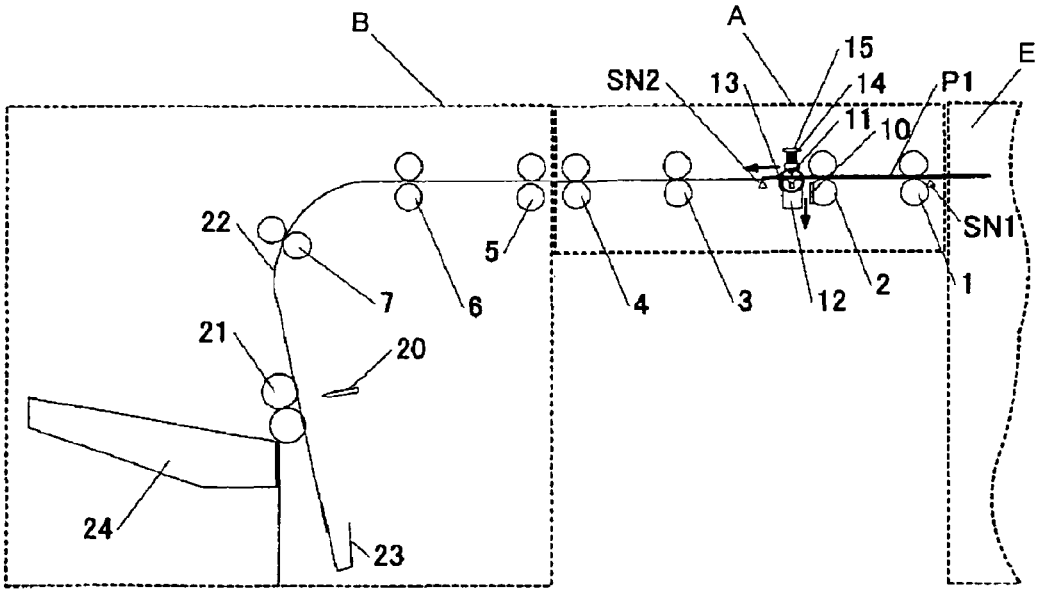
FIG. 4 is a schematic diagram for illustrating an operating state, following the situation of FIG. 3, where the front edge of the sheet is located at a position of a second sheet detection sensor.
Figure 5:
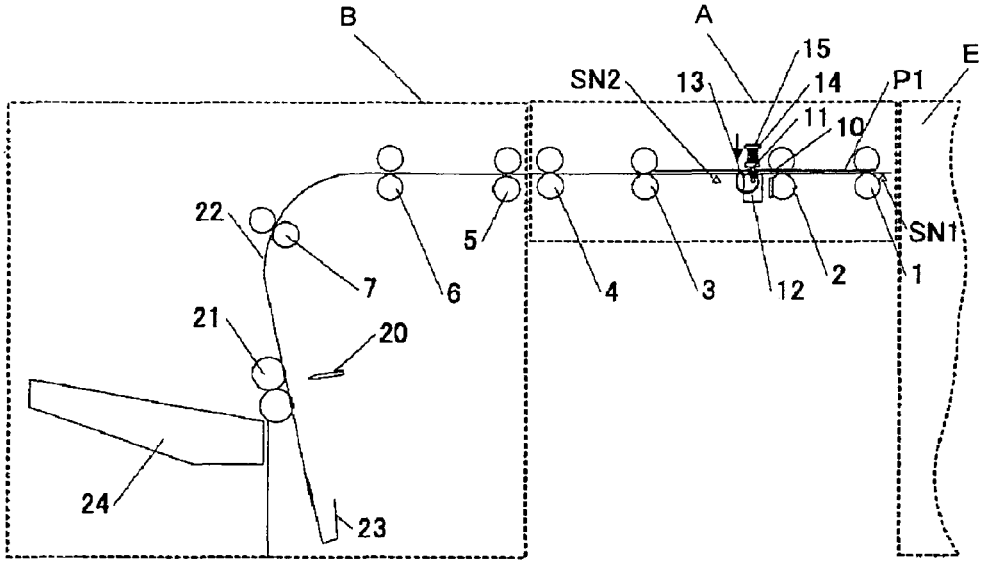
FIG. 5 is a schematic diagram for illustrating an operating state, following the situation of FIG. 4, where the sheet is situated at a creasing position and being performed creasing.

FIGS. 2 to 12 are schematic diagrams for illustrating a series of operations from creasing (scoring) to folding. As illustrated in FIG. 2, the sheet P1 delivered from the image forming apparatus E passes by an entrance sensor (first sheet detection sensor) SN1. The first to the fourth pairs of conveying rollers 1, 2, 3, and 4 are triggered by detection information output from the entrance sensor SN1. As illustrated in FIG. 3, the sheet P1 is conveyed by the first and the second pairs of conveying rollers 1 and 2 and brought into contact with the abutment plate 10 once, to thus be subject to skew correction. After completion of the skew correction, the abutment plate 10 descends in a direction indicated by an arrow in FIG. 4. Thereafter, the sheet P1 is further conveyed. When a second sheet detection sensor SN2 senses a front edge of the sheet P1, the second sheet detection sensor SN2 outputs a detection signal. The sheet P1 is then conveyed by a predetermined distance with reference to the detection signal. As illustrated in FIG. 5, when a center of the sheet P1 comes to a position provided with the creasing blade 11, the driving cam 13 rotates, causing the creasing blade 11 to descend. The sheet P1 is subjected to pressure by a pressure spring 14, thereby being creased between the creasing blade 11 and the receiving member 12.

Figure 6:
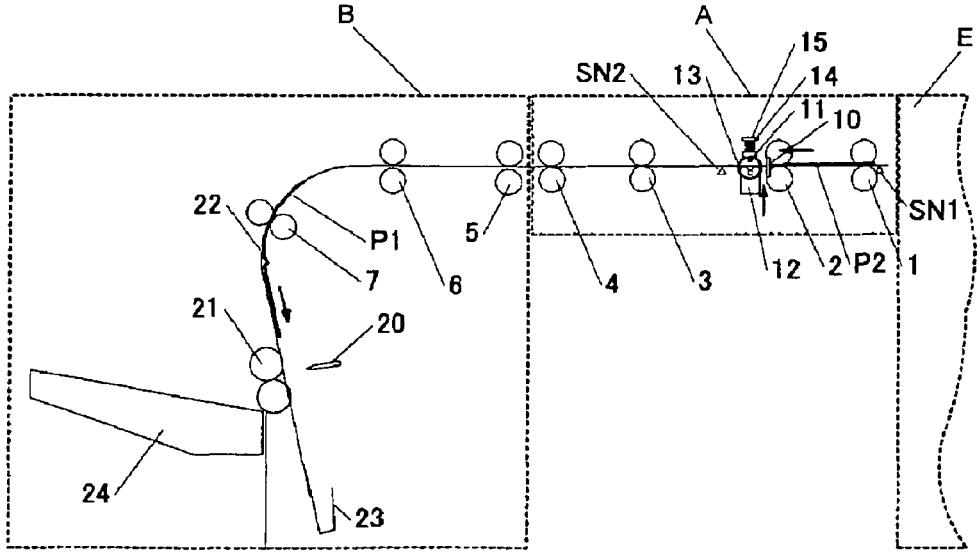
FIG. 6 is a schematic diagram for illustrating an operating state, following the situation of FIG. 5, where a front edge of the sheet enters a folding treatment tray.
Figure 7:
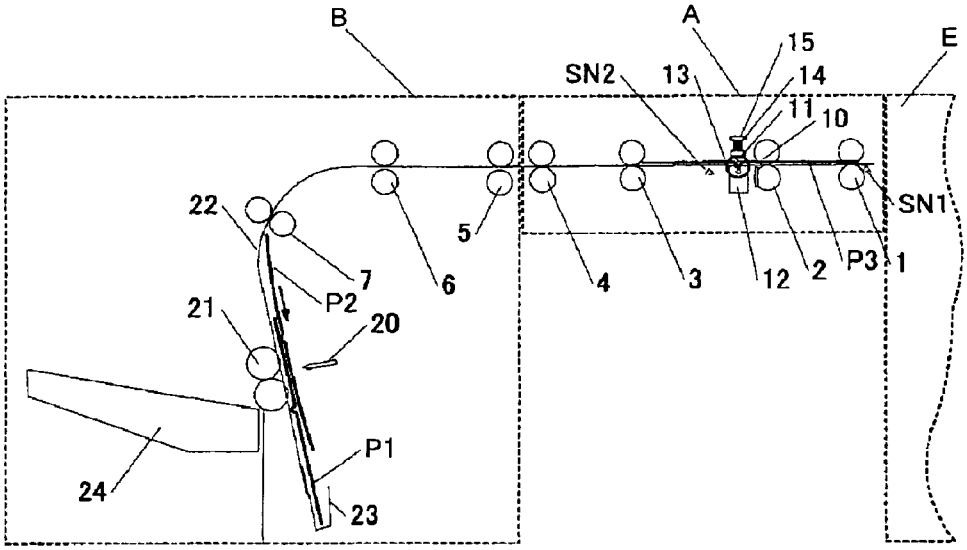
FIG. 7 is a schematic diagram for illustrating an operating state, following the situation of FIG. 6, where a second sheet enters the folding treatment tray.
Figure 8:
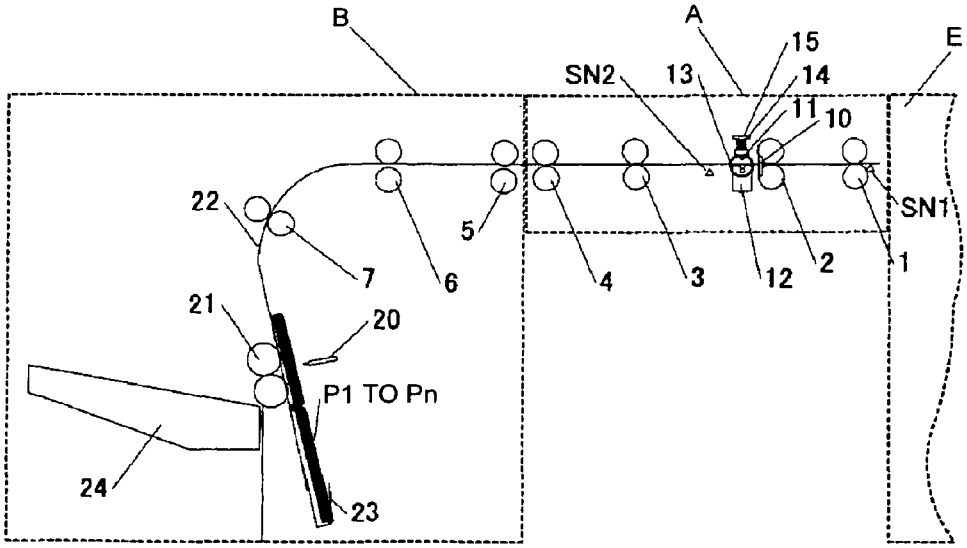
FIG. 8 is a schematic diagram for illustrating an operating state, following the situation of FIG. 7, where a plurality of creased sheets are accumulated on the folding treatment tray.
Figure 9:
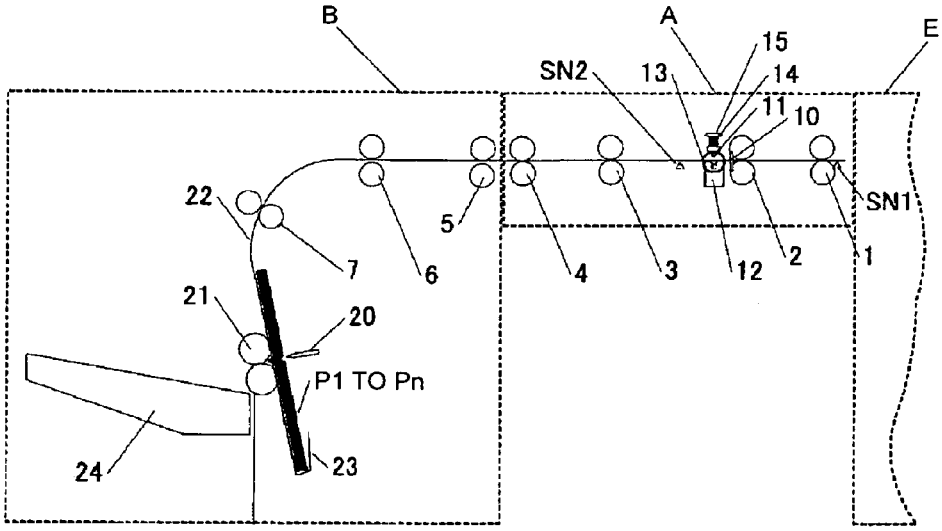
FIG. 9 is a schematic diagram for illustrating an operating state, following the situation of FIG. 8, where the plurality of creased sheets accumulated on the folding treatment tray are uplifted to a folding position by a reference fence.
Figure 10:
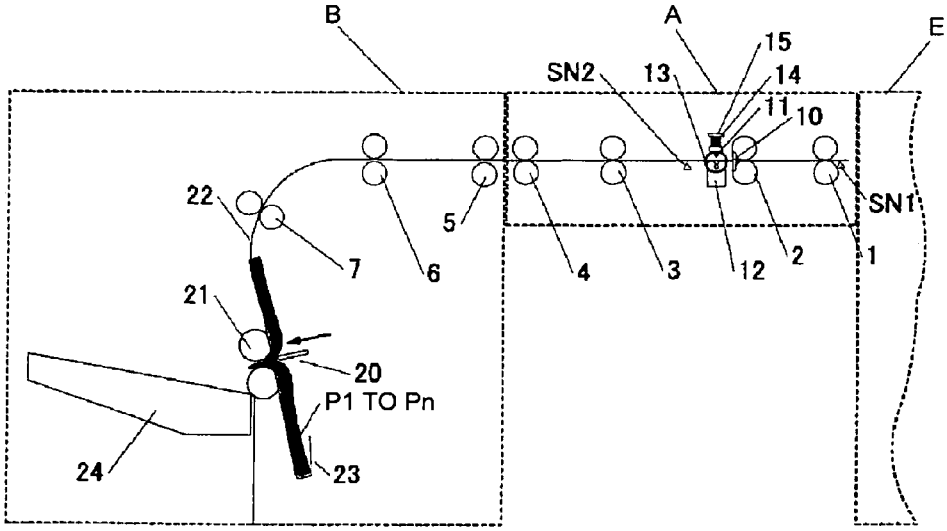
FIG. 10 is a schematic diagram for illustrating an operating state, following the situation of FIG. 9, where the sheets are pressed into a nip between a pair of folding rollers by a folding plate.
Figure 11:
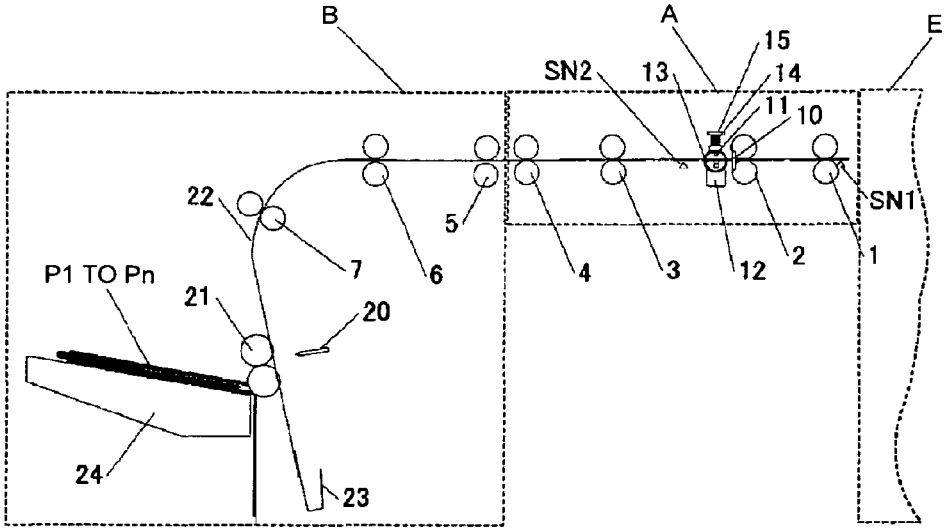
FIG. 11 is a schematic diagram for illustrating an operating state where a sheet batch has been folded and stacked on a stacking tray.

As illustrated in FIG. 6, the creased sheet P1 is conveyed to the folding device B by the third and the fourth folding rollers 3 and 4 and conveyed by the fifth, the sixth, and the seventh folding rollers 5, 6, and 7 to the folding unit D in the folding device B. As illustrated in FIG. 7, succeeding sheets P2, P3 and Pn are also creased by the creasing blade 11 and conveyed to the folding device B in a similar manner. As illustrated in FIGS. 8 and 9, a batch of sheets P1 to Pn stacked on the folding unit is held by the reference fence and conveyed until a creased portion of the batch of sheets P1 to Pn reaches a position provided with the folding unit. Subsequently, as illustrated in FIG. 10, the folding plate 20 moves in a direction (toward a nip between the pair of folding rollers) indicated by an arrow to press the batch of sheets P1 to Pn into the nip between the pair of folding rollers 21, causing the pair of folding rollers 21 to perform folding treatment. The batch of folded sheets P1 to Pn is sequentially stacked on the stacking tray 24 as illustrated in FIG. 11. The series of operations from creasing to folding is performed in this manner.

Although not shown, the creasing unit C adapts to a fold style, such as Z-fold, by producing creases corresponding to the number of times folding to be performed.

Figure 12A:
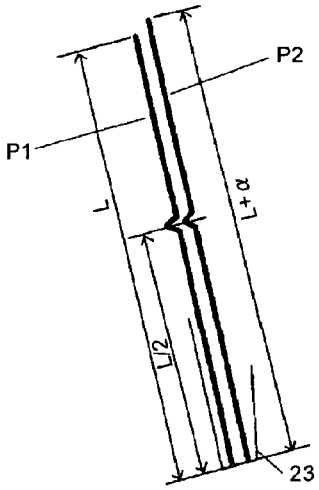
FIGS. 12A and 12B are schematic diagrams each illustrating a situation where creased sheets are stored in the folding treatment tray.

In the configuration illustrated in FIGS. 2 to 11, the reference position for creasing position is the front edge of the sheet as illustrated in FIG. 4. Also for folding, after skew is corrected at the front edge of the sheet by the reference fence, the sheet is moved to a folding position where the sheet is folded. Accordingly, a fold position is also determined by, reference to the front edge of the sheet. When such a combination as discussed above is employed, even when sheets that are dimensionally varied, offset between the crease position and the fold position will not occur because, as illustrated in FIG. 12A, the position and the fold position of the sheets are determined by reference to the same reference. More specifically, when the length of the first sheet P1 in the conveying direction is L, the length of the second sheet P2 in the conveying direction is $L+\alpha$, and the sheets are folded at a position of L/2 from the front edge of the first sheet P1, the sheets are creased at the position of L/2 from the front edge of the first sheet P1 and folded at the position because the reference fence 23 serves as the front edge reference for fold position.

Figure 13:
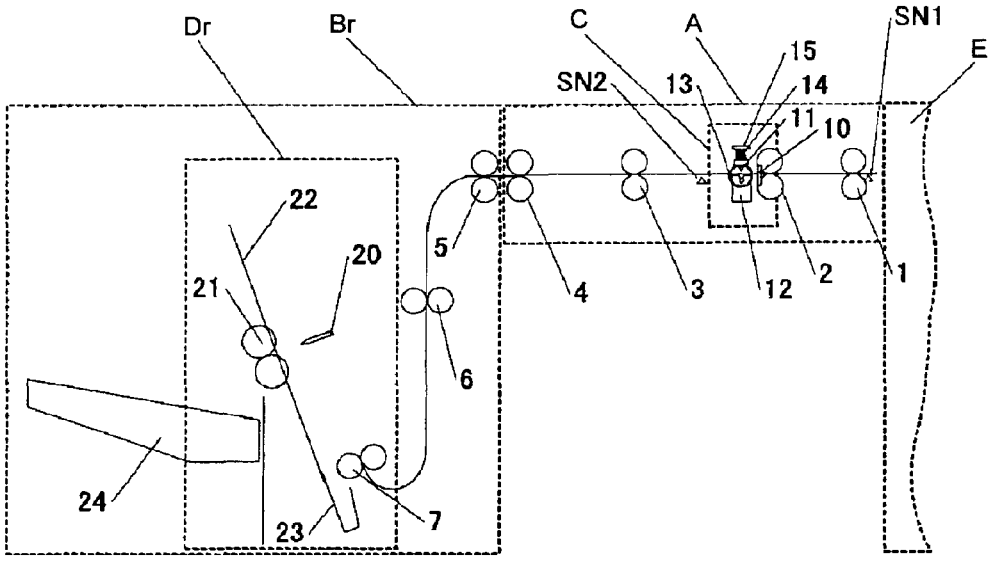
FIG. 13 is a schematic diagram illustrating a system configuration of an image forming system including a rear-edge-based folding device according to the first example of the embodiment of the present invention.

FIG. 13 is a schematic diagram illustrating a system configuration of an image forming system, in which a fold position for the folding unit is determined by reference to a rear edge of a sheet. The image forming system includes the creasing device A, a folding device Br that performs folding treatment, and the image forming apparatus E. Elements similar to those illustrated in FIGS. 1 to 11 are denoted by like reference numerals and symbols, and repeated descriptions are omitted.

This system differs from the system illustrated in FIG. 1 in the configuration of a folding unit Dr of the folding device Br. The folding unit Dr is constructed such that the seventh conveying rollers 7 are positioned on the side of a lower end of the folding tray 22 to deliver a sheet from the side of the lower end; the delivered sheet at a rear edge is brought into contact against the reference fence 23 provided at a lower end of the folding tray 22 that serves as a reference for the rear edge of the sheet. Hence, the folding tray 22 carries the sheet with the rear edge of the sheet abutting on the reference fence 23. Accordingly, although the situation in FIG. 1 and the situation in FIG. 13 are identical in relation between the folding tray 22 and the reference fence 23, differ from each other in a conveyance position of a sheet to the seventh conveying rollers 7. Thus, the reference fence 23 illustrated in FIG. 1 serves as a front-edge reference whereas the reference fence 23 illustrated in FIG. 13 serves as a rear-edge reference.

Figure 14:
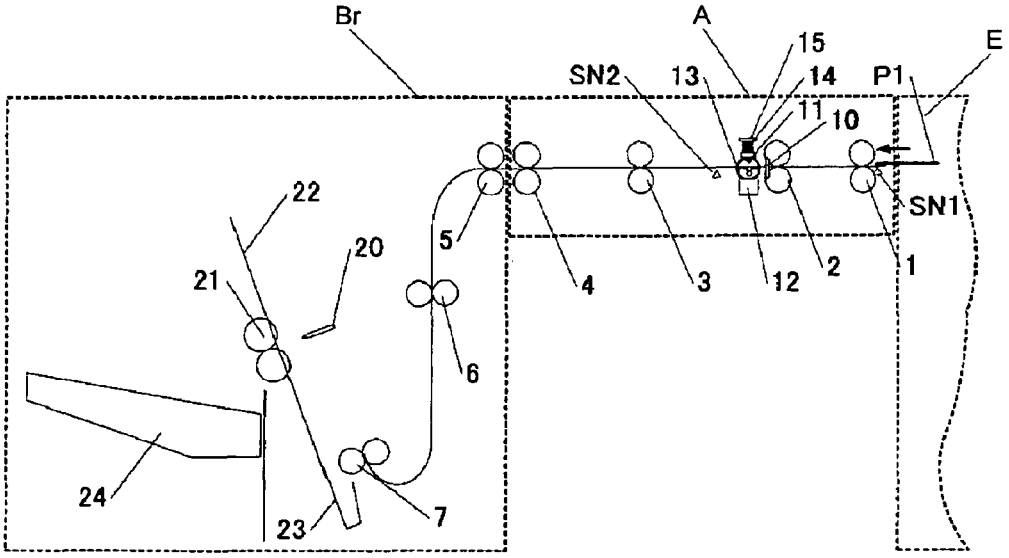
FIG. 14 is a schematic diagram of the first example for illustrating a series of operations related to the rear-edge-based folding device from creasing to folding, the diagram illustrating a situation where a rear edge of a first sheet is located at the position of the entrance sensor.
Figure 15:
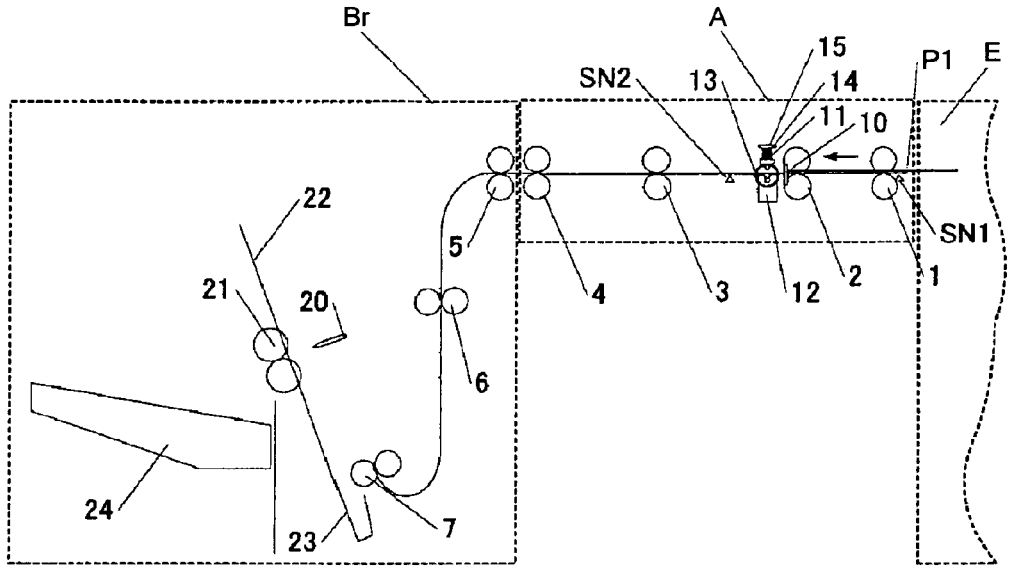
FIG. 15 is a schematic diagram for illustrating an operating state, following the situation of FIG. 14, where the sheet is brought into contact with the abutment plate.

As illustrated in FIG. 14, the sheet P1 delivered from the image forming apparatus E passes by the entrance sensor SN1. The first to the fourth conveying rollers 1, 2, 3, and 4 are triggered by detection information output from the entrance sensor SN1. As illustrated in FIG. 15, the sheet P1 is conveyed by the first and the second conveying rollers 1 and 2 and brought into contact with the abutment plate 10 once and is subject to skew correction. After completion of the skew correction, the abutment plate 10 descends in a direction indicated by an arrow in FIG. 16. The sheet P1 is further conveyed. The creasing device A determines controlling crease position based on either the front edge of the sheet or the rear edge of the sheet based on reference information of fold-position for the folding treatment for the subsequent process. In the configuration illustrated in FIGS. 13 to 23, the folding device Br is configured to determine a fold position by reference to a rear edge of a sheet; accordingly, the creasing device A also performs controlling the crease position by reference to the rear edge of the sheet.

Figure 16:
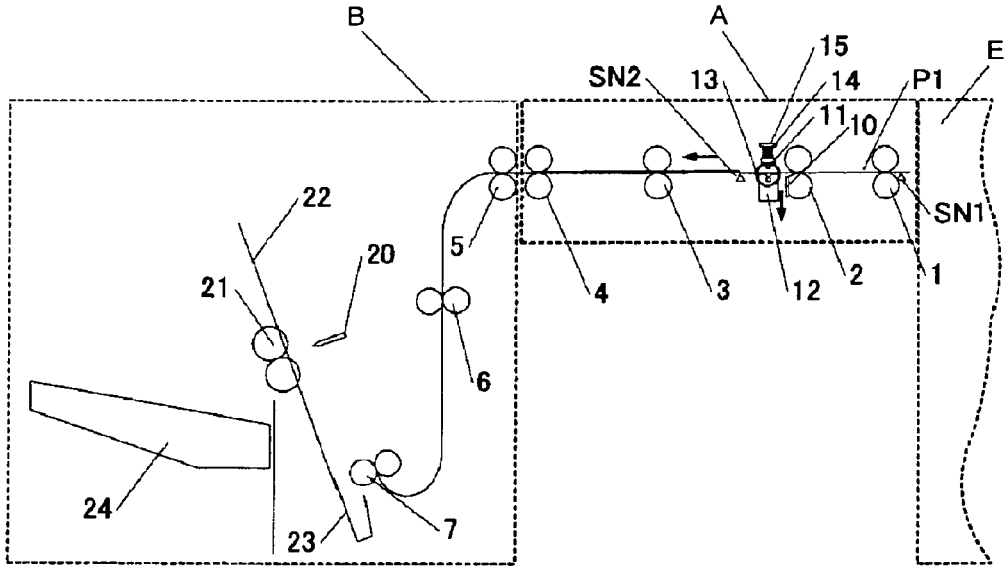
FIG. 16 is a schematic diagram for illustrating an operating state, following the situation of FIG. 15, where the front edge of the sheet is located at the position of the second sheet detection sensor.
Figure 17:
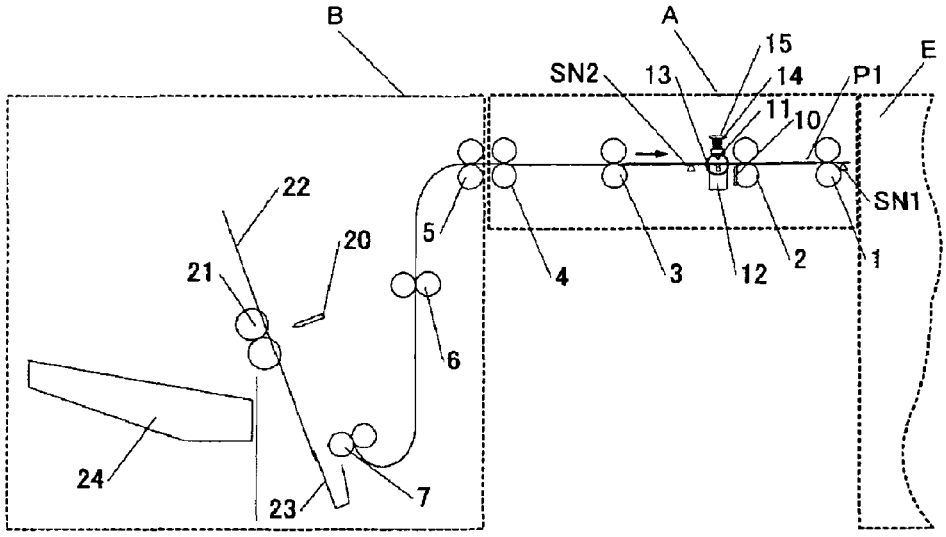
FIG. 17 is a schematic diagram for illustrating an operating state, following the situation of FIG. 16, where the sheet is reversed and conveyed in a upstream direction.
Figure 18:
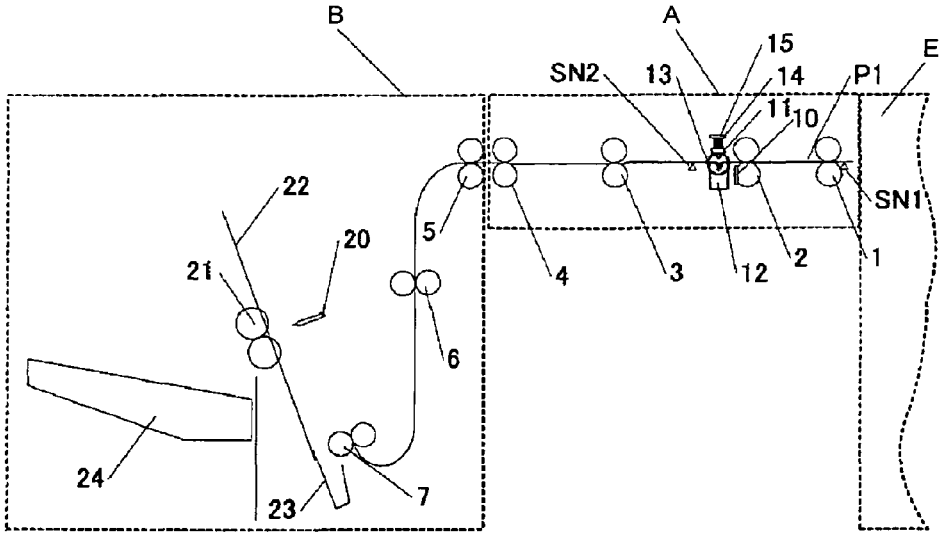
FIG. 18 is a schematic diagram for illustrating an operating state, following the situation of FIG. 17, where the sheet is located and stopped at the creasing position where the sheet is creased.
Figure 19:
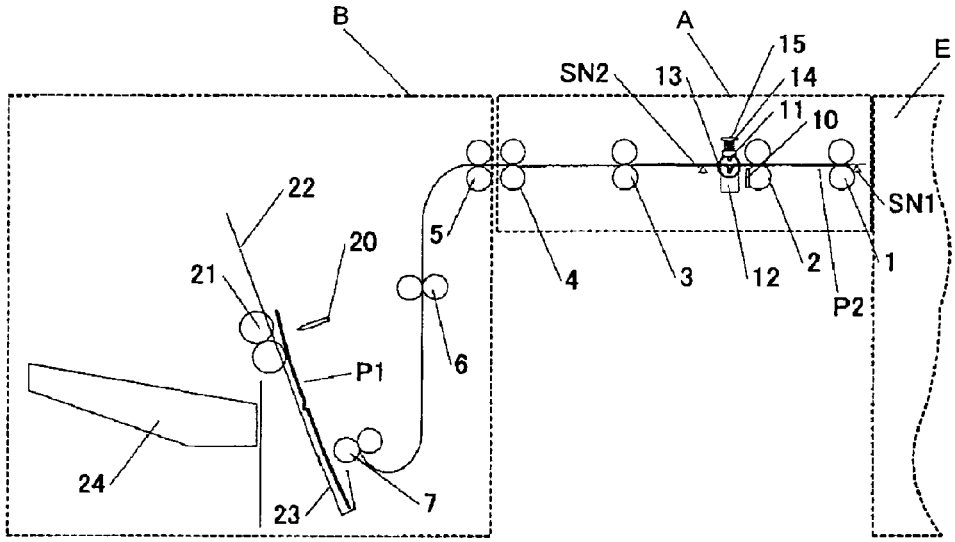
FIG. 19 is a schematic diagram for illustrating an operating state, following the situation of FIG. 18, where the first sheet has been stored in the folding treatment tray and a second sheet is creased.

As illustrated in FIG. 16, the second sheet detection sensor SN2 detects a position of the rear edge of the sheet. As illustrated in FIGS. 17 and 18, the sheet P1 is conveyed upstream by a predetermined distance based on a detection signal output from the second sheet detection sensor SN2. When the center of the sheet by reference to the rear edge of the sheet is located at the position provided with the creasing blade 11, the drive cam 13 is rotated, causing the creasing blade 11 to descend. The sheet P1 is subjected to pressure by the pressure spring 14, thereby being creased. Subsequently, as illustrated in FIG. 19, the creased sheet P1 is conveyed to the folding device Br by the third and the fourth folding rollers 3 and 4 and then conveyed to the folding unit Dr by the fifth, the sixth, and the seventh folding rollers 5, 6, and 7 in the folding device Br. The subsequent sheet P2 to Pn are also creased by the creasing blade 11 and conveyed to the folding unit Dr in a similar manner.

Figure 20:
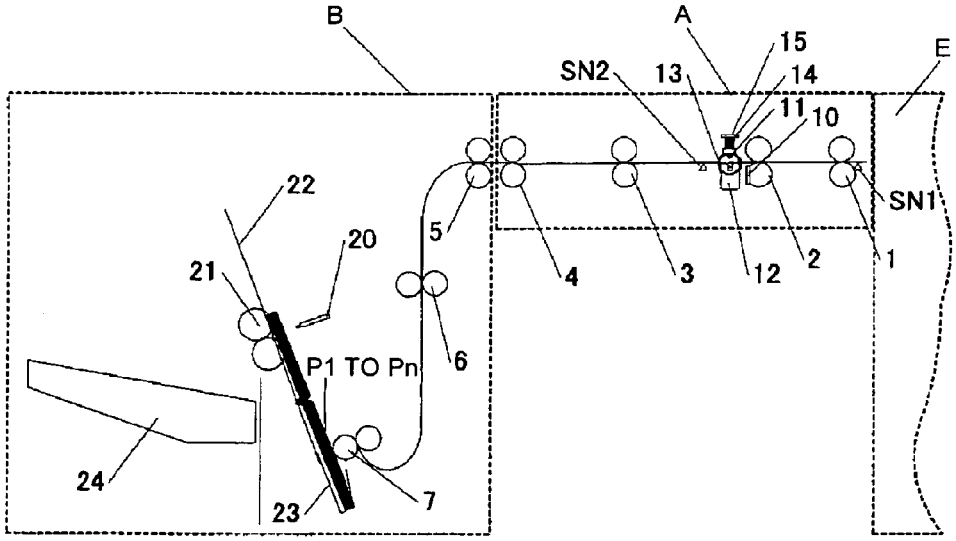
FIG. 20 is a schematic diagram for illustrating an operating state, following the situation of FIG. 19, where a plurality of creased sheets are stored in the folding treatment tray.
Figure 21:
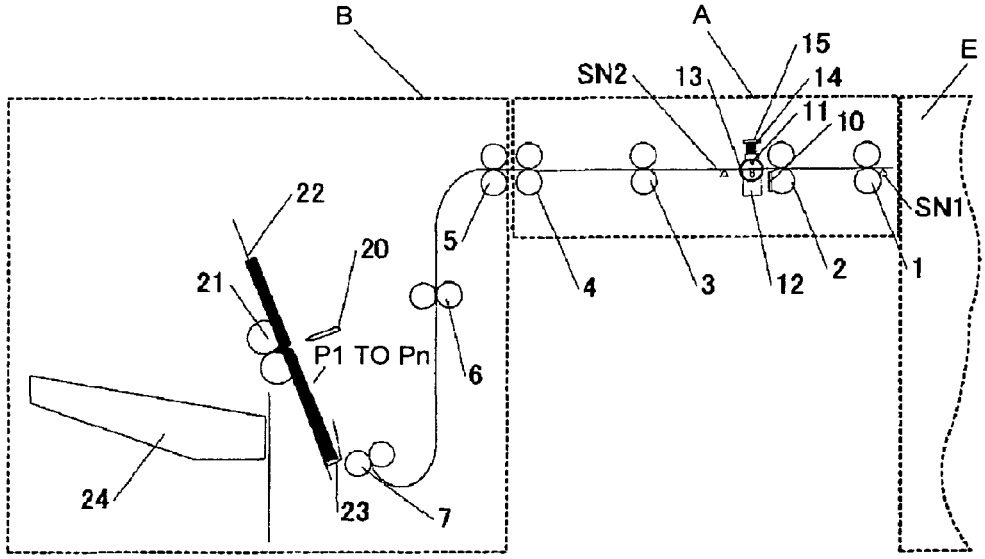
FIG. 21 is a schematic diagram for illustrating an operating state, following the situation of FIG. 20, where the plurality of creased sheets accumulated on the folding treatment tray are uplifted to a folding position by the reference fence.
Figure 22:
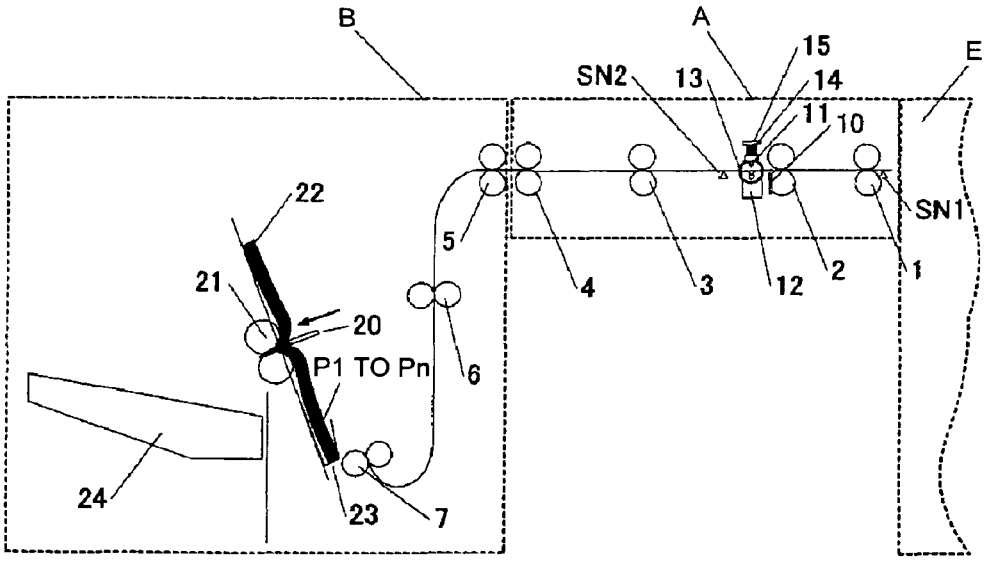
FIG. 22 is a schematic diagram for illustrating an operating state, following the situation of FIG. 21, where the sheets are pressed into the nip between the pair of folding rollers by the folding plate.
Figure 23:
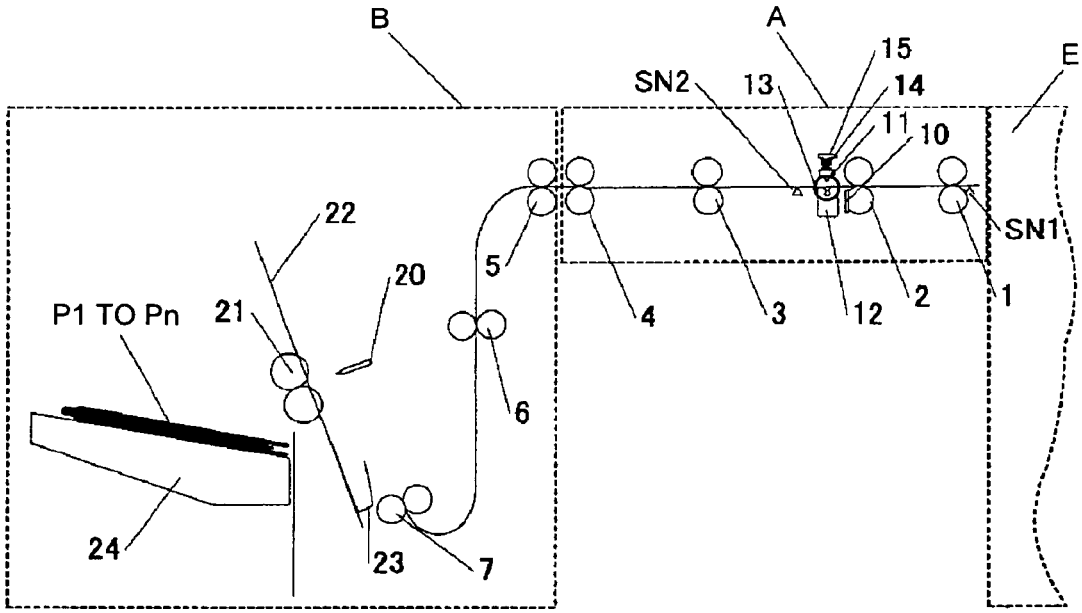
FIG. 23 is a schematic diagram for illustrating an operating state where folding treatment to a sheet batch has been completed and stacked on the stacking tray.

As illustrated in FIGS. 20 and 21, the batch of stacked sheets P1 to Pn on the folding tray 22 is uplifted until the creased portion of the batch of sheets P1 to Pn supported by the rear-end fence 23 reaches a position provided with the folding plate 20. As illustrated in FIG. 22, the folding plate 20 moves in a direction indicated by an arrow and forces the batch of sheets P1 to Pn into the nip between the pair of folding rollers 21 to perform folding treatment. The batch of folded sheets P1 to Pn is delivered to and stacked on the stacking tray 24 as illustrated in FIG. 23.

The series of operations from creasing to folding is performed in this manner.

Figure 24:
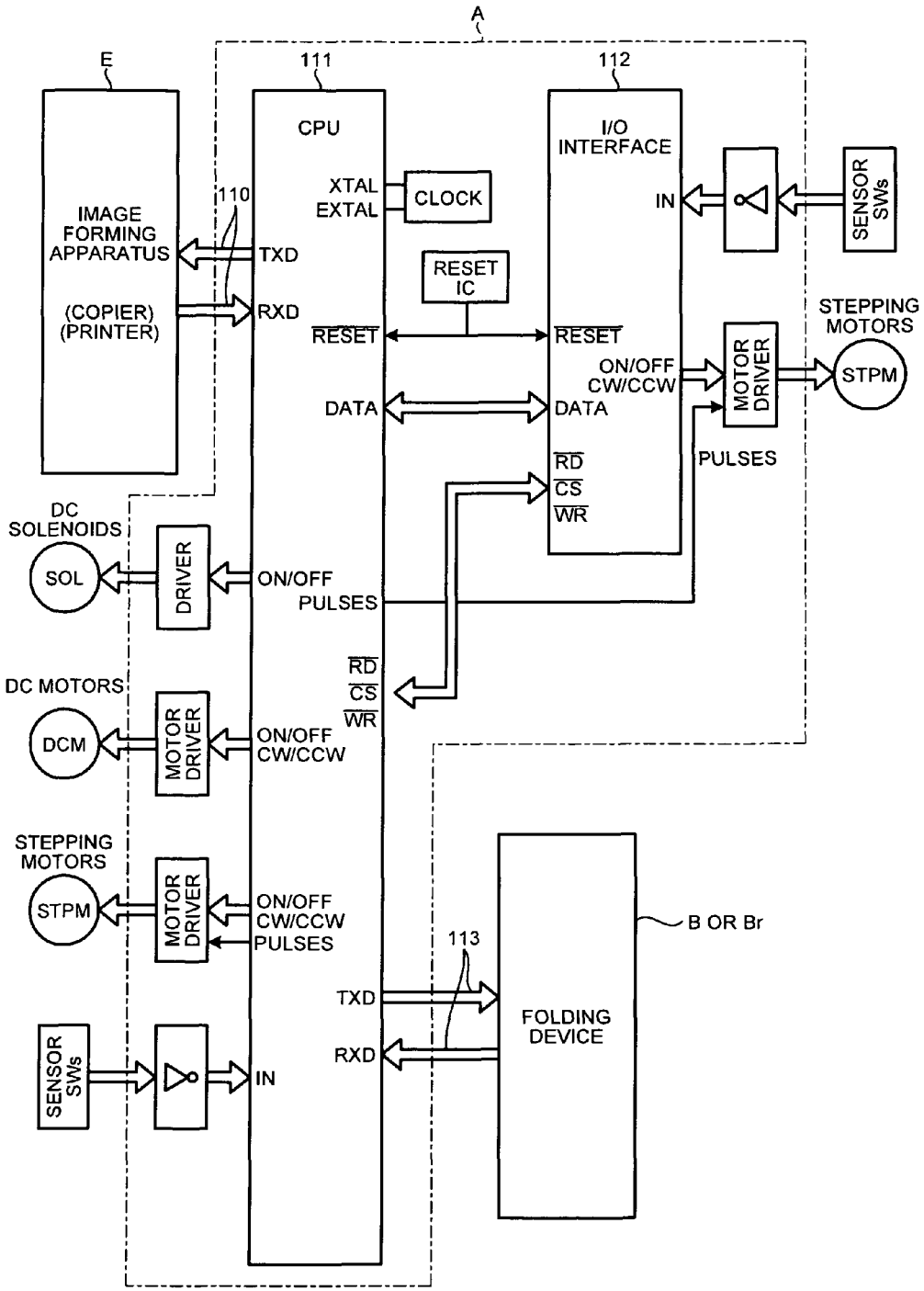
FIG. 24 is a block diagram illustrating a control structure of an image forming system including the creasing device, a folding device that performs folding treatment, and the image forming apparatus.

FIG. 24 is a block diagram illustrating control structure of the image forming system including the creasing device A, the folding device B or Br that performs folding treatment, and the image forming apparatus E. The creasing device A includes a control circuit equipped with a microcomputer including a CPU 111 and an input/output (I/O) interface 112. Signals are fed to the CPU 111 from the CPU, various switches on a control panel, and various sensors (not shown) of the image forming apparatus E via a communications interface 110. The CPU 111 performs predetermined control operations based on fed signals. The CPU 111 receives signals similar to those mentioned above from the folding device B or Br via a communication interface 113 and performs predetermined control operations based on fed signals. The CPU 111 also performs drive control for solenoids and motors via drivers and motor drivers and obtains sensor information in the device via the interface. The CPU 111 also performs drive control for motors via the I/O interface 112 and via motor drivers according to an entity to be controlled and sensors and obtains sensor information from sensors. Control operations discussed above are performed by reading program codes stored in read only memory (ROM) (not shown) and executing program instructions defined in the program codes while using RAM (not shown) as a working area and data buffer.

Figure 25:
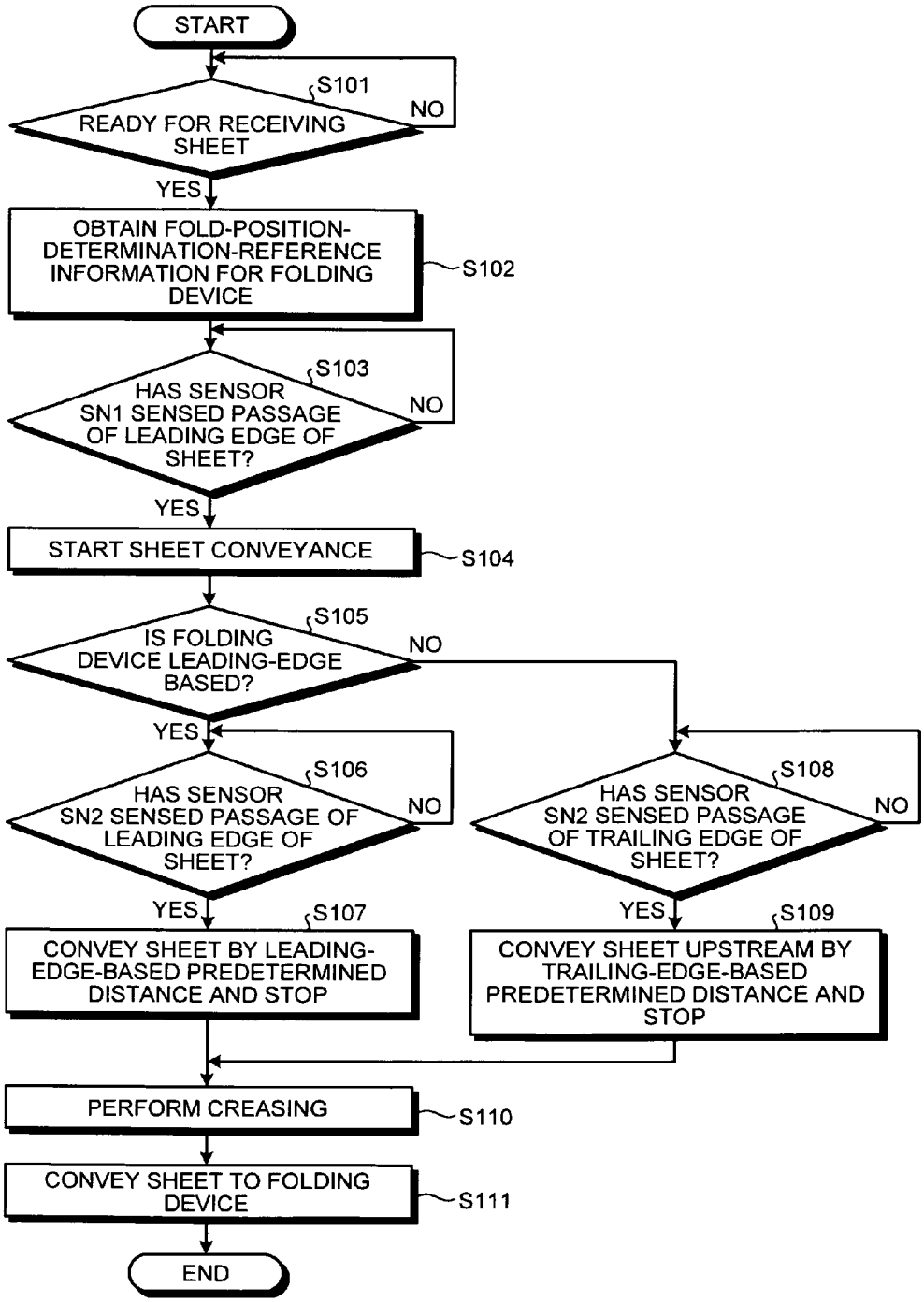
FIG. 25 is a flowchart illustrating a series of procedure of operations from creasing to folding to be performed by a CPU of the creasing device of the first example implementation.

FIG. 25 is a flowchart illustrating a series of procedure of operations from creasing to folding performed by the CPU 111 of the creasing device A. Referring to FIG. 25, when the creasing device A is ready for receiving a sheet (Step S101), the CPU 111 of the creasing device A obtains reference information of the fold-position for the folding device B (Step S102). The CPU 111 obtains reference information of the fold-position from the image forming apparatus E or the folding device B via the communication interface 110 or 113.

After reference information of the fold-position is obtained, the entrance sensor SN1 detects passage of a front edge of a sheet delivered from the image forming apparatus E (Step S103). When passage of the front edge is detected by the entrance sensor SN1, conveyance of the sheet is started by the conveying rollers 1 to 7 (Step S104). Subsequently, whether the folding device B is front-edge or rear-edge basis is checked based on reference information of the fold-position obtained at Step S102 (Step S105). If it is checked that the folding device B is based on front-edge, the sheet is conveyed from a time point where the front edge of the sheet has cut off the sheet detection sensor SN2 (YES at Step S106) by a predetermined distance (for an instance of half fold, for example, until a crease position is at a half length in the conveying direction of the sheet) and stopped at the position (Step S107). The creasing blade 11 is caused to descend to perform creasing (scoring treatment) of the sheet between the receiving member 12 and the creasing blade 11 (Step S110). The sheet is then conveyed to the folding device B (Step S111).

On the other hand the folding device B is not based on front-edge in Step S105, treatment is performed assuming that the folding device B is based on rear-edge, and the sheet is conveyed upstream from a time point where the sheet detection sensor SN2 has sensed a rear edge of the sheet (YES at Step S108) by a predetermined distance (in a case of half fold, for instance, until a crease position is located at a distance of a half length of the sheet in the sheet conveying direction) and stopped at the position (Step S109). Creasing treatment is performed (Step S110) and the sheet is conveyed to the folding device B (Step S111). Thus, the crease position is determined at Step S107 or at Step S109.

Figure 12B:
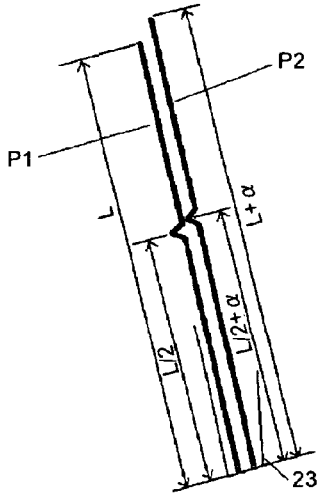

By performing control operations in such a manner as in the flowchart illustrated in FIG. 25, it is allowed to adapt to a front-edge-based folding device and a rear-edge-based folding device. Since a reference for determining a crease position and a fold position is same, accordingly, even when sheets are slightly dimensionally varied, offset between a crease position and a fold position will not occur as illustrated in FIG. 12A. In contrast, when a crease position is determined based on only either a front edge or a rear edge without performing the control operations discussed above, offset between the crease position and a fold position can occur as illustrated in FIG. 12B.

Second Example

In the first example, if the folding device is rear-edge basis based on a detection output of the sheet detection sensor SN2, a sheet delivered to the creasing device A is moved in a reverse direction (upstream) before the sheet undergoes creasing. A second example is an example adapted to a rear-edge basis without moving the sheet in the reverse direction, or upstream.

More specifically, in the second example, there are provided two sensors, or, more specifically, the entrance sensor SN1 and the sheet detection sensor SN2 capable of detecting a front edge or a rear edge of a sheet. In the second example, crease position control is performed based on an output signal of one of the different sensors according to reference information of fold-position for the folding device B.

Figure 26:
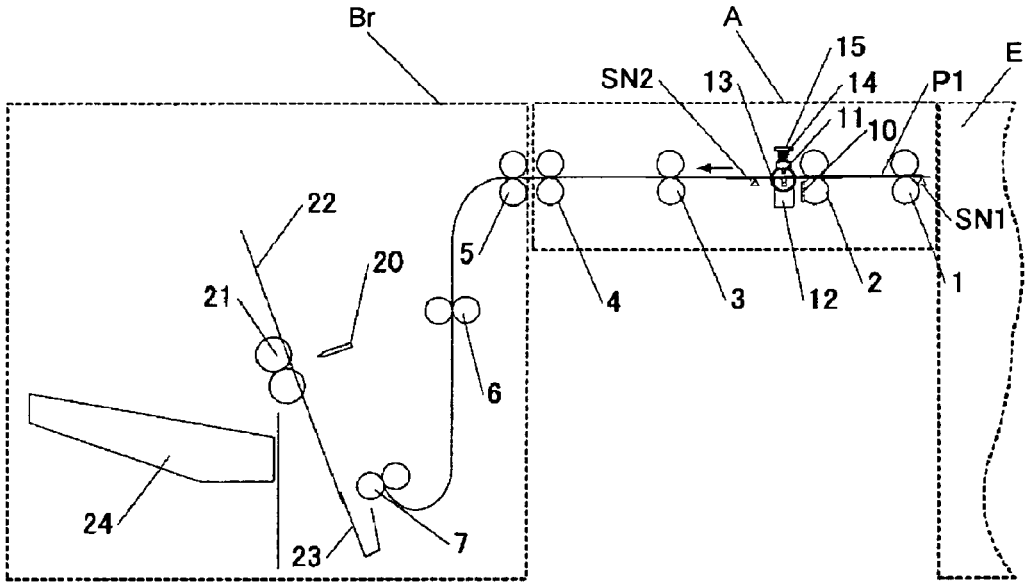
FIG. 26 is a schematic diagram for illustrating an operating state where a front edge of a first sheet to the front-edge-based folding device has passed through the creasing unit according to a second example.
Figure 27:
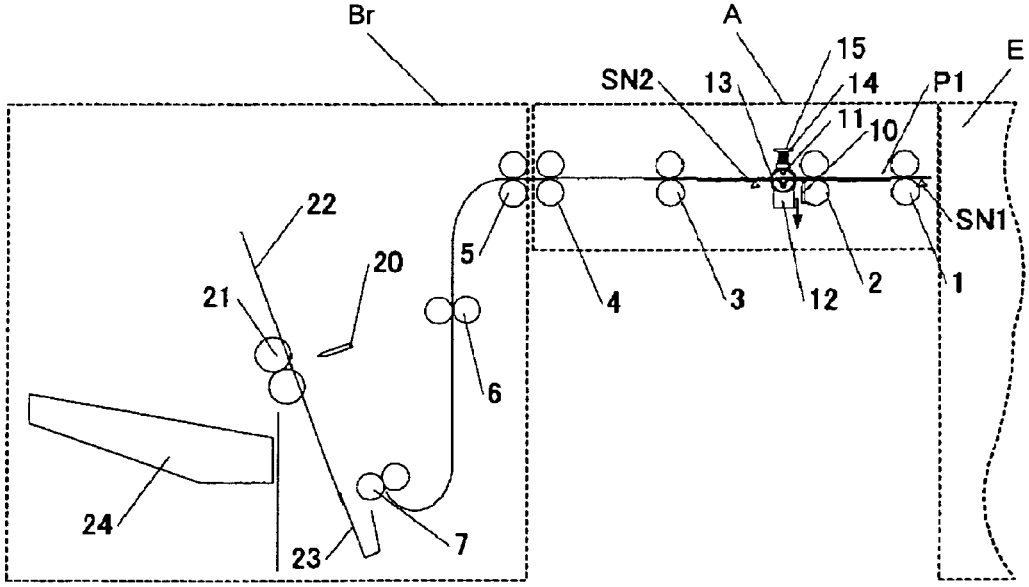
FIG. 27 is a schematic diagram for illustrating an operating state where the first sheet to the rear-edge-based folding device is creased according to the second example.

More specifically, the creasing device A determines to control the crease position using which one of a front edge of or a rear edge of a sheet as a reference based on reference information of the fold-position for the folding process, which is the subsequent process. In the configuration illustrated in FIG. 26, the folding device Br is configured to determine a fold position by reference to a rear edge of a sheet; accordingly, the creasing device A also control the crease position by reference to the rear edge of the sheet. As illustrated in FIG. 27, the entrance sensor SN1 detects a position of the rear edge of the sheet. Following operations for conveying the sheet by a predetermined distance, creasing the sheet, and conveying the sheet to the folding device are similar to those of first example discussed above.

As illustrated in FIG. 4 and discussed above, when the folding device B has a configuration based on a front edge of a sheet, a crease position is determined based on a sheet detection signal output from the second sheet detection sensor SN2. This control allows that a process for conveying a sheet upstream can be eliminated even when the folding device is rear-edge based, which leads to reduction in sheet processing time, or, in other words, an increase in productivity.

Figure 28:
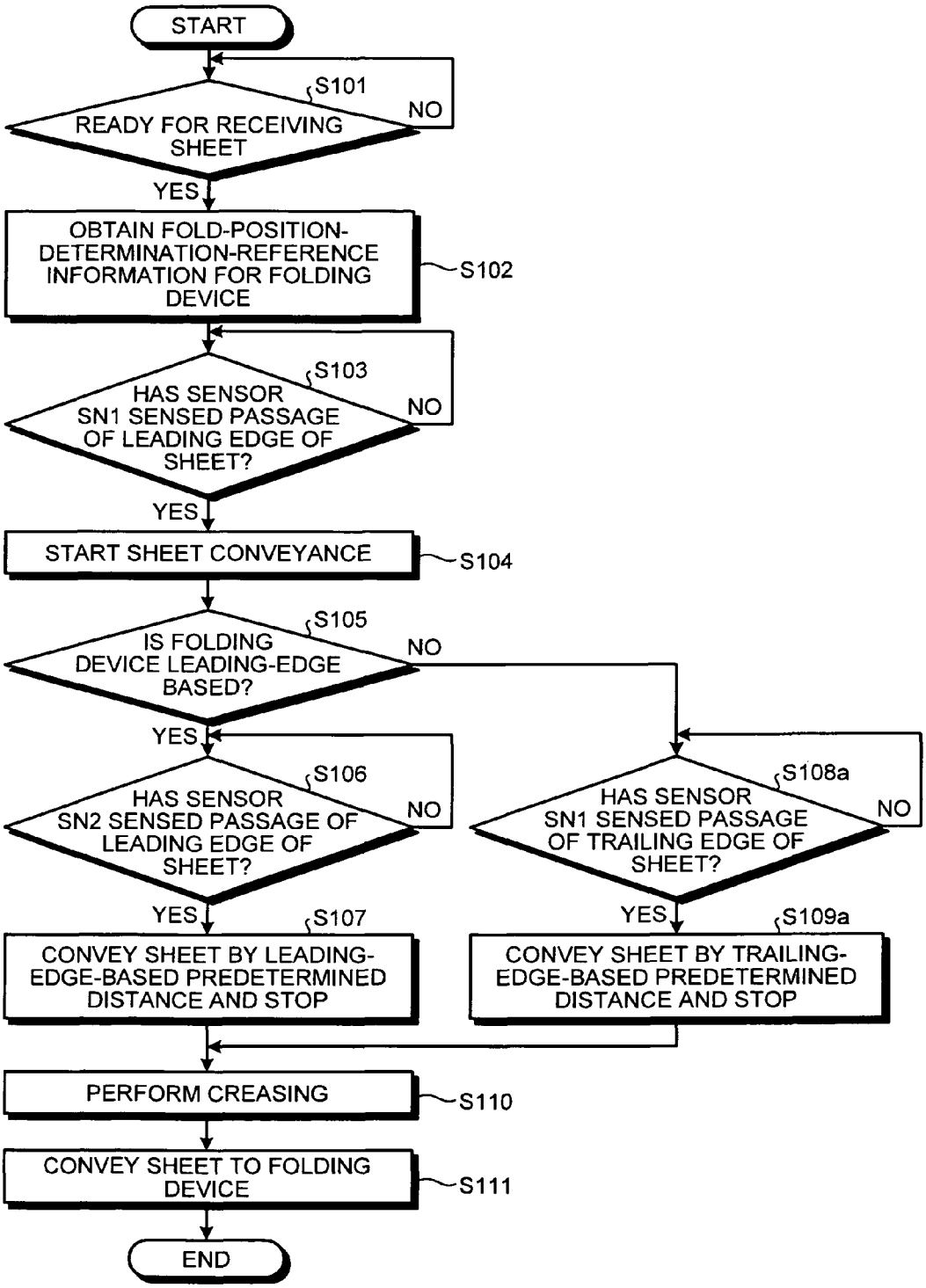
FIG. 28 is a flowchart illustrating a procedure of operations to be performed by the CPU of the creasing device according to the second example.

FIG. 28 is a flowchart illustrating a procedure of operations to be performed by the CPU 111 of the creasing device A in the second example implementation. This flowchart is similar to the flowchart of the first example illustrated in FIG. 25 but Step S108 and Step S109 are replaced with Step S108*a* and Step S109. More specifically, if the folding device B is based on rear-edge rather than front-edge, the sheet is conveyed from a time point where the rear edge of the sheet has cut off the entrance sensor SN1 (YES at Step S108*a*) by a predetermined distance (in a case of half fold, for instance, until the crease position is located at a distance of a half length of the sheet in the sheet conveying direction from the rear edge of the sheet) and stopped (Step S109*a*). Thereafter, the sheet is creased (Step S110) and conveyed to the folding device B (Step S111).

Other elements of the second example implementation have similar configurations and functions to those of the first example implementation.

Third Example

In the second example, creasing of a sheet is performed without conveying the sheet in the reverse direction, or upstream, by using the entrance sensor (first sheet detection sensor) SN1 and the second sheet detection sensor SN2. A third example is also an example that a sheet is creased based on a rear edge of a sheet without reversely conveying the sheet in the upstream direction. FIG. 29 is a schematic diagram illustrating a configuration in the third example that a plurality of sheet detection sensors that provides a reference for a crease position are arranged. In the third example, a third sheet detection sensor SN3 is arranged between the entrance sensor SN1 and the creasing unit C in the creasing device A. In the configuration illustrated in FIG. 29, the folding device Br is based on a rear edge of a sheet; accordingly, the creasing device A also controls crease position by reference to the rear edge of the sheet.

Figures 29, 30:
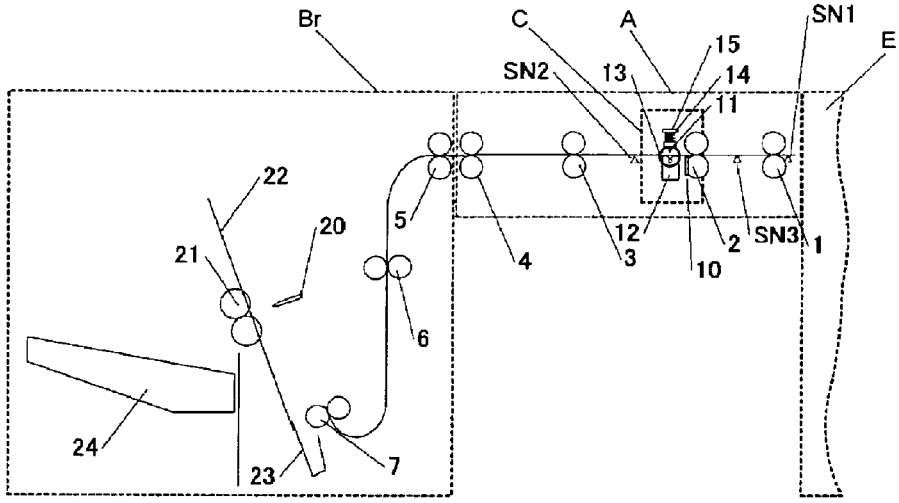
FIG. 29 is a schematic diagram illustrating a configuration where a plurality of sheet detection sensors detecting a reference for a crease position are arranged according to a third example.
FIG. 30 is a diagram illustrating an example of a table used in the third example.
Figure 31:
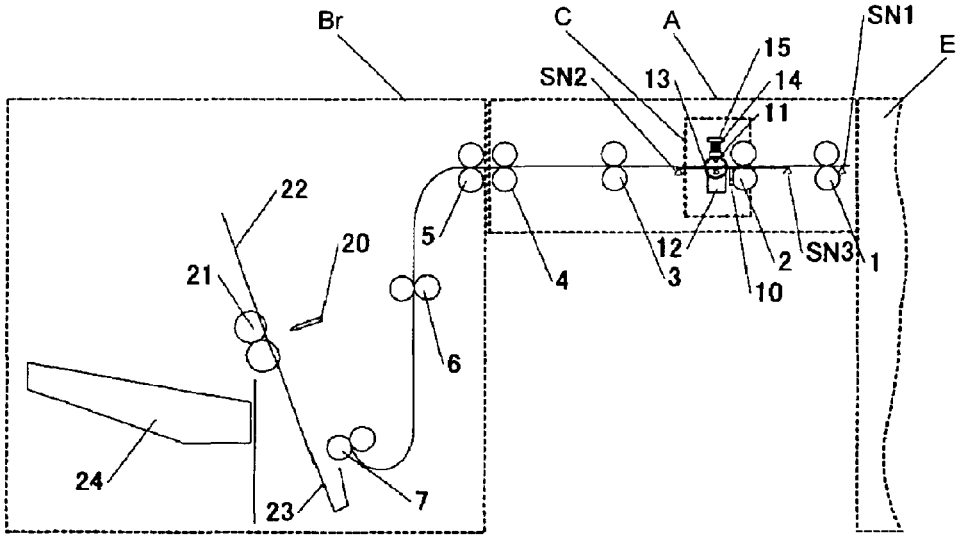
FIG. 31 is a schematic explanatory diagram illustrating an operating state where, after a third sheet detection sensor detects a rear edge of a sheet, the sheet is conveyed by a predetermined distance by reference to the rear edge and stopped according to the third example.
Figure 32:
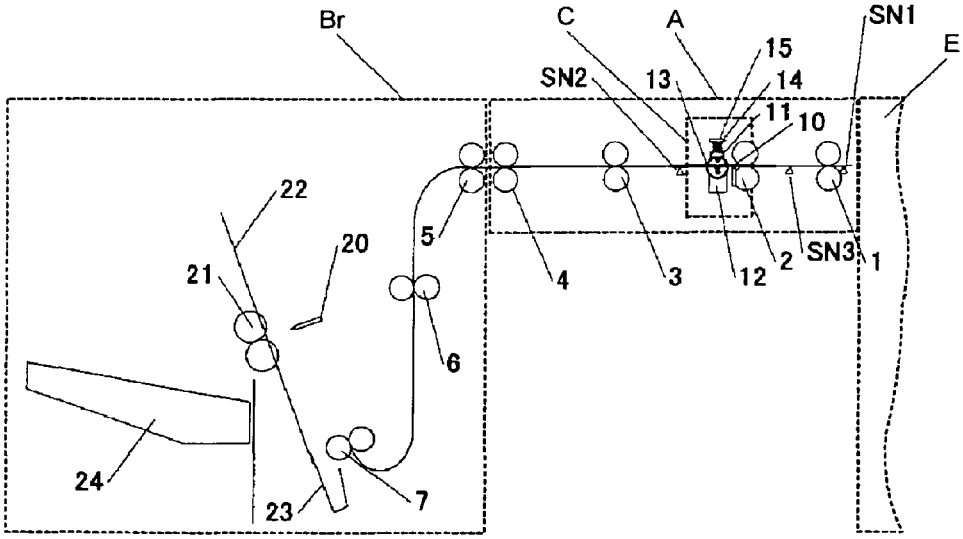
FIG. 32 is a schematic diagram for illustrating an operating state, following the situation of FIG. 31, where a creasing blade is driven to perform creasing.

Meanwhile, the CPU 111 stores such a table as illustrated in FIG. 30 in the RAM (not shown) in the circuit control. This table indicates relation among sheet size information, fold positions in fold style, such as a fold position for center fold, a first fold position for Z-fold, a second fold position for Z-fold, and the first and the third sheet detection sensors SN1 and SN3 used in determination of a reference. The CPU 111 obtains sheet-size information and fold-style information from the image forming apparatus E or the folding device B and refers to the table of FIG. 30 to select one of an output signal from the first sheet detection sensor SN1 and an output signal from the third sheet detection sensor SN3 for use as a reference for crease position control. The CPU 111 detects a rear edge of a sheet based on the output signal of the selected sheet detection sensor. Referring to FIG. 31, after the rear edge of the sheet cuts off the third sheet detection sensor SN3, the sheet is conveyed based on a rear-edge by a predetermined distance and stopped. The creasing blade 11 is driven as illustrated in FIG. 32 to crease the sheet. Thereafter, the sheet is conveyed to the folding device B where the sheet is folded as in the first example.

With the configuration based on a detection of rear edge, this control is performed based on the sheet detection sensor, which is closer to the creasing unit C, among those. Accordingly, influence exerted by sheet slippage that can occur during sheet conveyance or the like can be lessened. As a result, accuracy of the crease position can be improved. Meanwhile, as a matter of course, if the folding device B is based on a front-edge, creasing is performed at a conveyance distance after a front edge of the sheet has cut off the second sheet detection sensor SN2.

Figure 33:
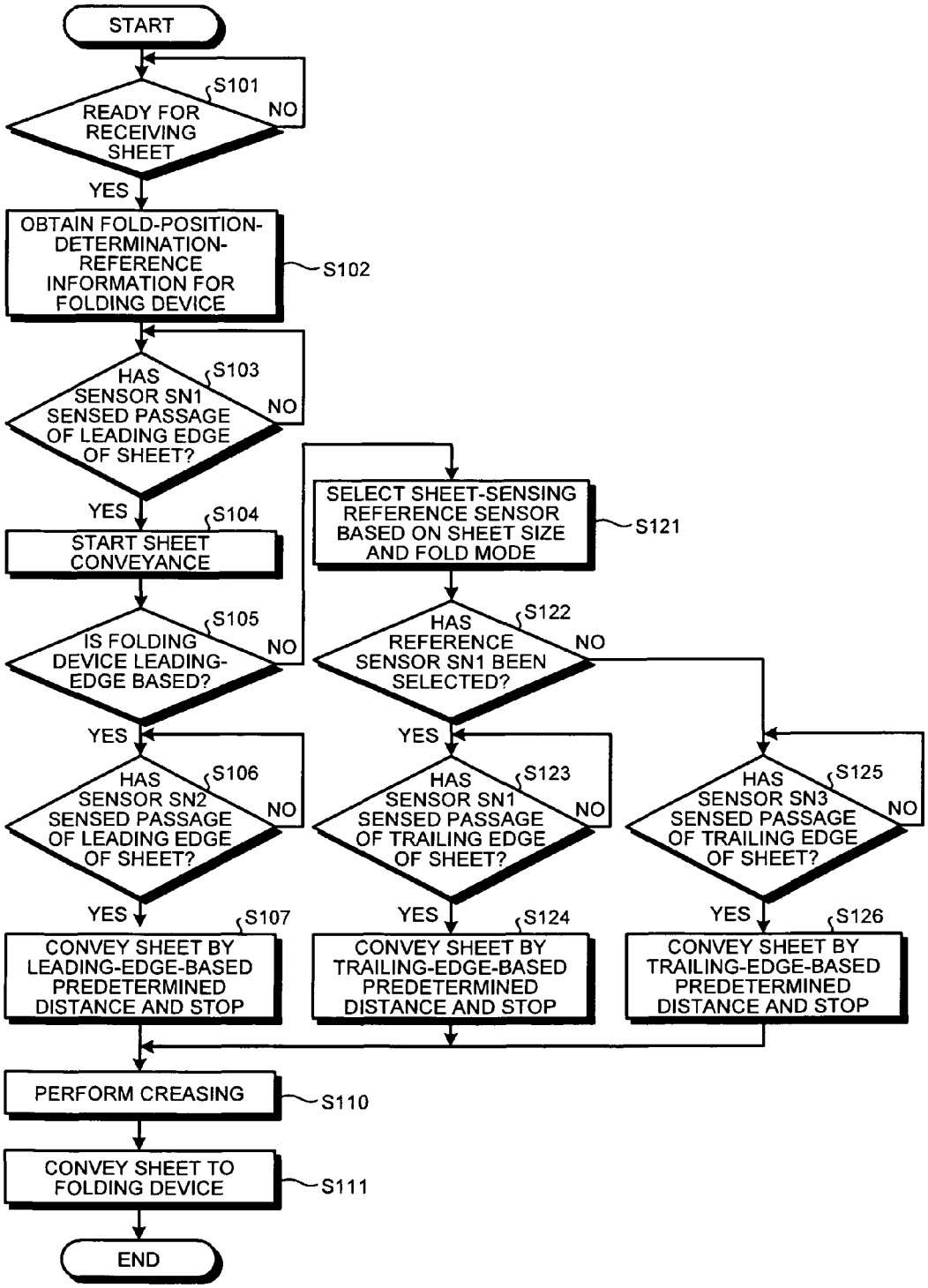
FIG. 33 is a flowchart illustrating a procedure of operations to be performed by the CPU of the creasing device according to the third example.

FIG. 33 is a flowchart illustrating a procedure of operations performed by the CPU 111 of the creasing device A in the third example implementation. This flowchart is similar to the flowchart of the first example illustrated in FIG. 25 but Step S108 and Step S109 are replaced with Step S121 to Step S126.

More specifically, if the folding device B is based on rear-edge rather than front-edge, a sheet detection reference sensor is selected from the table in FIG. 30 based on obtained sheet-size information and fold-style information (Step S121). If the entrance sensor SN1 is selected as the reference sensor (YES at Step S122), from a starting point where the entrance sensor SN1 detected passage of the rear edge of the sheet (YES at Step S123), the sheet is conveyed by a predetermined distance from rear-edge of the sheet and stopped (Step S124). Creasing is then performed (Step S110).

If the entrance sensor SN1 is not selected as the reference sensor at step S122, from a starting point where the third sheet sensor SN3 detected passage of the rear edge of the sheet (YES at Step S125), the sheet is conveyed by a predetermined distance from a rear-edge of the sheet and stopped (Step S126). Creasing is then performed (Step S110).

By whichever route the sheet is conveyed, after creasing, the sheet is conveyed to the folding device B (Step S111) where the sheet is folded.

As discussed above, according to the present embodiment, the same sheet position reference for creasing as that for the folding process, which is a subsequent process, irrespective of whichever sheet position detection reference is employed in the folding process. Accordingly, occurrence of offset between a crease position and a fold position is prevented even when sheets are dimensionally varied. This allows a crease to be produced on a fold position with relatively high accuracy in advance, thereby improving quality of folding subsequent to creasing.

According to an aspect of the present invention, a same sheet position reference as that for a folding process, which is a process subsequent to creasing, can be applied to the creasing. Accordingly, occurrence of offset between a crease position and a fold position is prevented even when sheets are dimensionally varied.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing device comprising:

a creasing unit that creases sheets on a one-by-one basis, the sheets are to be conveyed to a folding device of a subsequent stage;

a sheet position detection unit that detects a position of a sheet delivered to the creasing unit for creasing relative to a sheet position reference for a sheet folding process; and a control unit that obtains reference information of a fold-position for the folding device and performs control of a stop position of the sheet at each of the creasing unit and the folding device according to the reference information of the fold position and the detected sheet position reference, thereby adjusting a crease position.

2. The creasing device according to claim 1, wherein the creasing device includes a plurality of sheet position detection units, and the control unit performs control of the stop position of the sheet based on a detection signal output from the sheet position detection unit selected according to the reference information of the fold-position.

3. The creasing device according to claim 2, wherein the control unit performs control of the stop position of the sheet based on a detection signal output from the sheet position detection unit selected according to the reference information of the fold-position and sheet-size information.

4. The creasing device according to claim 2, wherein the control unit determines to select a detection signal output from the sheet position detection unit as a reference according to the reference information of the fold-position, the sheet-size information, and fold-style information.

5. The creasing device according to claim 4, wherein the sheet-size information, the fold-style information, and the sheet position detecting unit as the reference are presented in a table in advance and stored in a storage unit.

6. The creasing device according to claim 1, further comprising a communication unit for carrying out communications with an apparatus connected with the creasing unit, wherein the control unit obtains reference information of the fold-position for the folding device via the communication unit.

7. An image forming system comprising:

the creasing device according to claim 1;

a folding device;

and an image forming apparatus for forming an image on a sheet member.

8. The creasing device according to claim 1, wherein the control unit obtains reference information of a fold-position for the folding device and performs control of a stop position of the sheet in the creasing unit according to reference information of the fold position of the folding device.

9. The creasing device according to claim 1, wherein the reference information is obtained from the sheet position detection unit.

10. The creasing device according to claim 1, wherein the control unit obtains reference information of a fold-position of a sheet to be folded in the folding device and obtains reference information of a crease-position of a sheet to be creased in the creasing unit and performs control of a stop position of the sheet in the creasing unit according to the obtained information.

11. The creasing device according to claim 10, wherein the reference information of the folding device and reference information of the creasing unit are obtained on a same sheet position detected by the sheet position detecting unit.

12. The creasing device according to claim 1, wherein the reference information of the fold-position includes information of an edge position of the sheet, the information of the edge position of the sheet being a reference of the fold-position, and the control unit controls the crease position based on the edge position of the sheet as the reference position.

* * * * *